United States Patent [19]

Scagnelli et al.

[11] 4,384,539

[45] May 24, 1983

[54] SLIDE FASTENER GUIDE ASSEMBLY

[75] Inventors: George J. Scagnelli, Essex Junction, Vt.; Robert L. Rohrer, Meadville, Pa.

[73] Assignee: Talon, Inc., Meadville, Pa.

[21] Appl. No.: 277,537

[22] Filed: Jun. 26, 1981

[51] Int. Cl.[3] ..... D05B 3/18; D05B 35/06

[52] U.S. Cl. ..... 112/105; 112/152

[58] Field of Search ..... 112/152, 105, 150, 104, 112/136, 235

[56] References Cited

U.S. PATENT DOCUMENTS

| | | | |
|---|---|---|---|
| 2,079,834 | 5/1937 | Blumenkrantz | 112/105 |
| 2,131,250 | 9/1938 | De Voe | 112/105 |
| 2,198,345 | 4/1940 | Legat | 112/105 |
| 2,542,212 | 2/1951 | Schaad | 112/152 |
| 2,667,849 | 2/1954 | Rohrlick et al. | 112/235 X |
| 2,776,635 | 1/1957 | Blumenkrantz | 112/105 |
| 2,977,904 | 4/1961 | Carmen | 112/105 |
| 3,016,028 | 1/1962 | Schreck et al. | 112/105 |
| 3,286,668 | 11/1966 | Rockerath et al. | 112/105 X |
| 4,069,780 | 1/1978 | Minami | 112/150 |

*Primary Examiner*—H. Hampton Hunter

*Attorney, Agent, or Firm*—Anthony A. O'Brien

[57] ABSTRACT

A slide fastener guide assembly is disclosed for aligning a workpiece, a slide fastener and a strip of backing material as they are fed into a sewing machine. The assembly includes a base with an attached guide member having fingers that bear against the mounting tapes and align the slide fastener by laterally engaging the coupling elements. To allow a slidered fastener to pass through the assembly, the guide member is sufficiently flexible that the fingers may be displaced upward by a slider passing thereunder.

6 Claims, 6 Drawing Figures

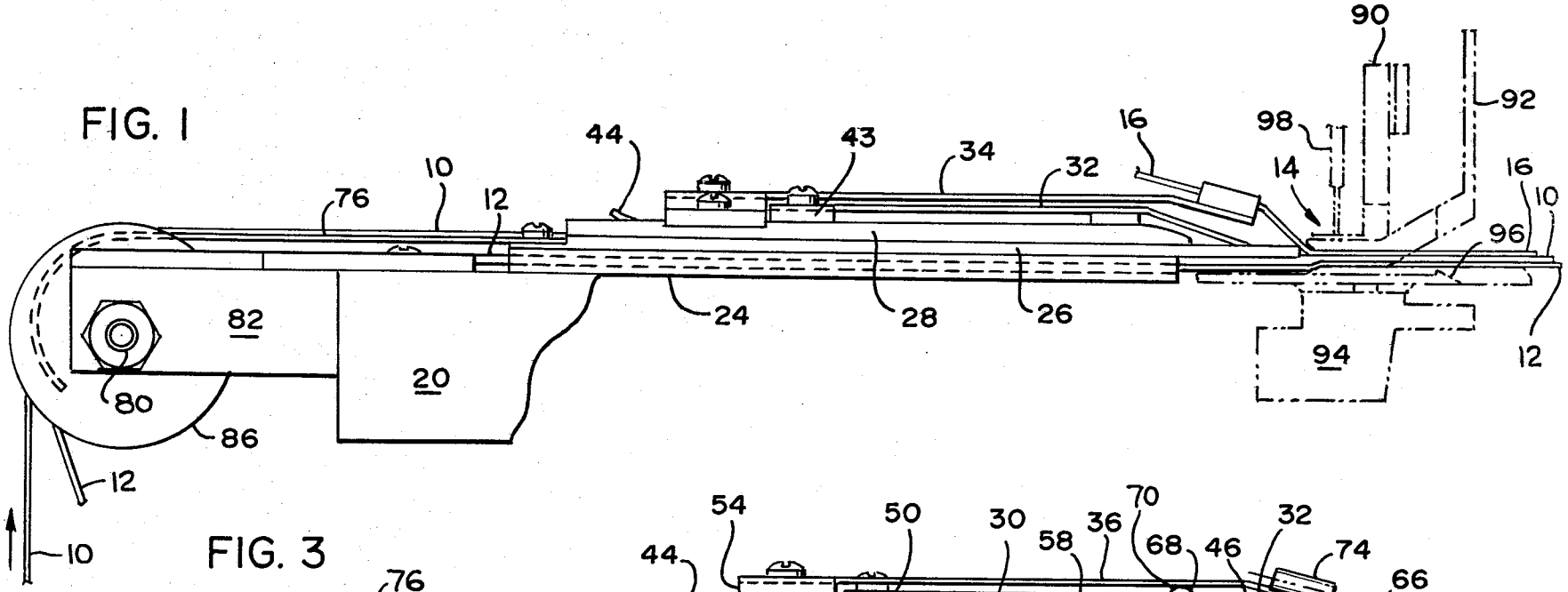
FIG. 1
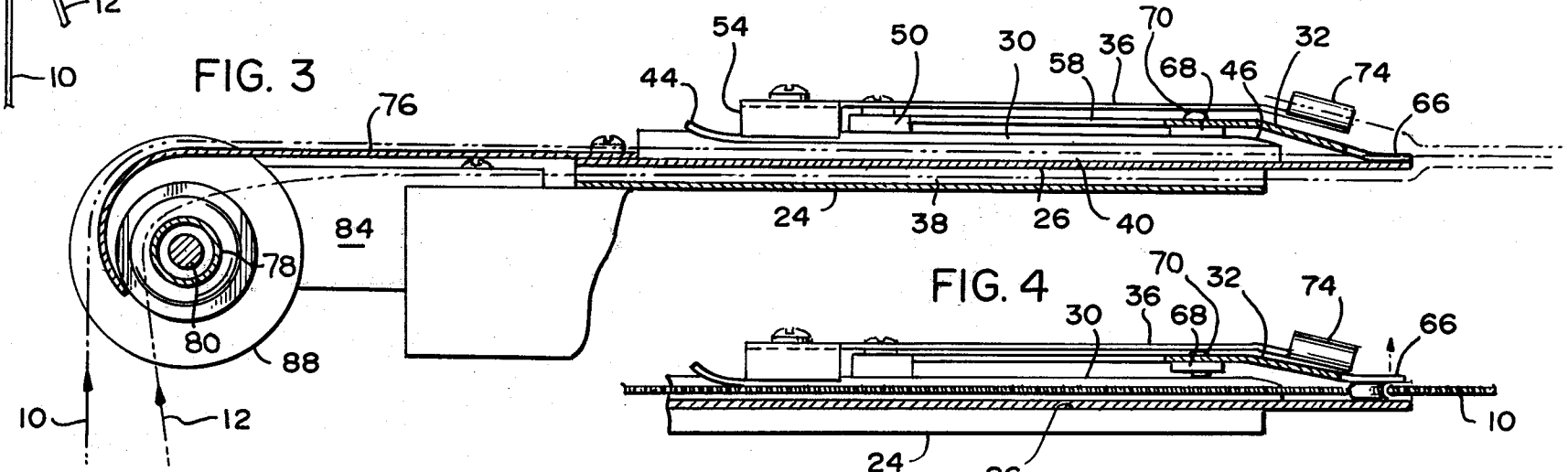
FIG. 3
FIG. 4

SLIDE FASTENER GUIDE ASSEMBLY

BACKGROUND OF THE INVENTION

1. Field of the Invention

This invention relates to an apparatus for installing slide fasteners—also called zippers—in articles such as boots.

2. Description of the Prior Art

The prior art relating to slide fastener installation machinery is exemplified by U.S. Pat. No. 2,542,212, U.S. Pat. No. 2,667,849, U.S. Pat. No. 2,776,635, U.S. Pat. No. 2,977,904, U.S. Pat. No. 3,016,028 and U.S. Pat. No. 4,069,780. Various means are suggested for feeding a slide fastener to an installation apparatus; for example, the apparatus shown in U.S. Pat. No. 2,776,635 includes guides for aligning a fabric opening with a slide fastener chain prior to one or more sewing operations.

SUMMARY OF THE INVENTION

This invention is summarized in a slide fastener guide assembly for aligning a slide fastener, which includes two mounting tapes supporting respective rows of coupling elements interlocked by a slider, with a workpiece as the slide fastener and the workpiece are fed into a sewing machine. The assembly includes a workpiece guide for engaging a longitudinal opening in the workpiece, a base having a channel for supporting the fastener, the base being attached to said workpiece guide, and a guide member for laterally positioning the fastener within the channel. The guide member includes a nose portion, a pair of spaced arms extending rearward from opposite sides of the nose portion parallel to and above the channel, the arms being attached at their rearward ends to the base, and a pair of fingers extending forward from the nose portion, the fingers having a space therebetween approximately equal to the width of the interlocked coupling elements, the fingers being downwardly offset from the arms so as to bear against the mounting tapes adjacent the coupling elements. The guide has sufficient flexibility that the fingers may be temporarily displaced upward by a slider moving thereunder.

A conventional slide fastener includes a slider, that is, a movable member defining a Y-shaped channel for joining and separating a pair of opposed stringers, each of which includes a mounting tape with a row of coupling elements attached along one edge of the tape. Not only is a slider body necessarily thicker than the interlocking coupling elements which pass through it, but also a pull tab is attached to one side of the slider, giving it a total thickness greatly exceeding that of any other part of the fastener. When attaching a slide fastener to a garment, the sewing threads pass close by the slider, so that either the machine operator must take care to avoid the slider, or a mechanism must be provided for doing so. The fastener, the garment, and any backing material used must be maintained in alignment at all times to provide an acceptable seam.

An object of the invention is to construct a device that can be mounted on a work table adjacent a sewing machine for aligning a workpiece with a fastener as the two are fed simultaneously to the sewing machine.

Another object is to provide a guide that laterally locates a slide fastener by engaging the ends of its interlocked coupling elements.

A further object of the invention is to construct a slide fastener guide which does not interfere with passage of a slider therethrough.

It is yet another object of the invention to enable an operator to feed both a fastener and backing material from respective reels beneath a work table in alignment with a workpiece.

Other objects, advantages and features of the invention will be apparent from the following description taken in conjunction with the accompanying drawings.

BRIEF DESCRIPTION OF THE DRAWINGS

FIG. 1 is a side elevation of an apparatus embodying the invention.

FIG. 3 is a cross-sectional view taken along the line 2—2 in FIG. 2.

FIG. 4 is a cross-sectional view similar to FIG. 3 showing part of the apparatus in a deflected position.

DESCRIPTION OF THE PREFERRED EMBODIMENT

Figure 2:
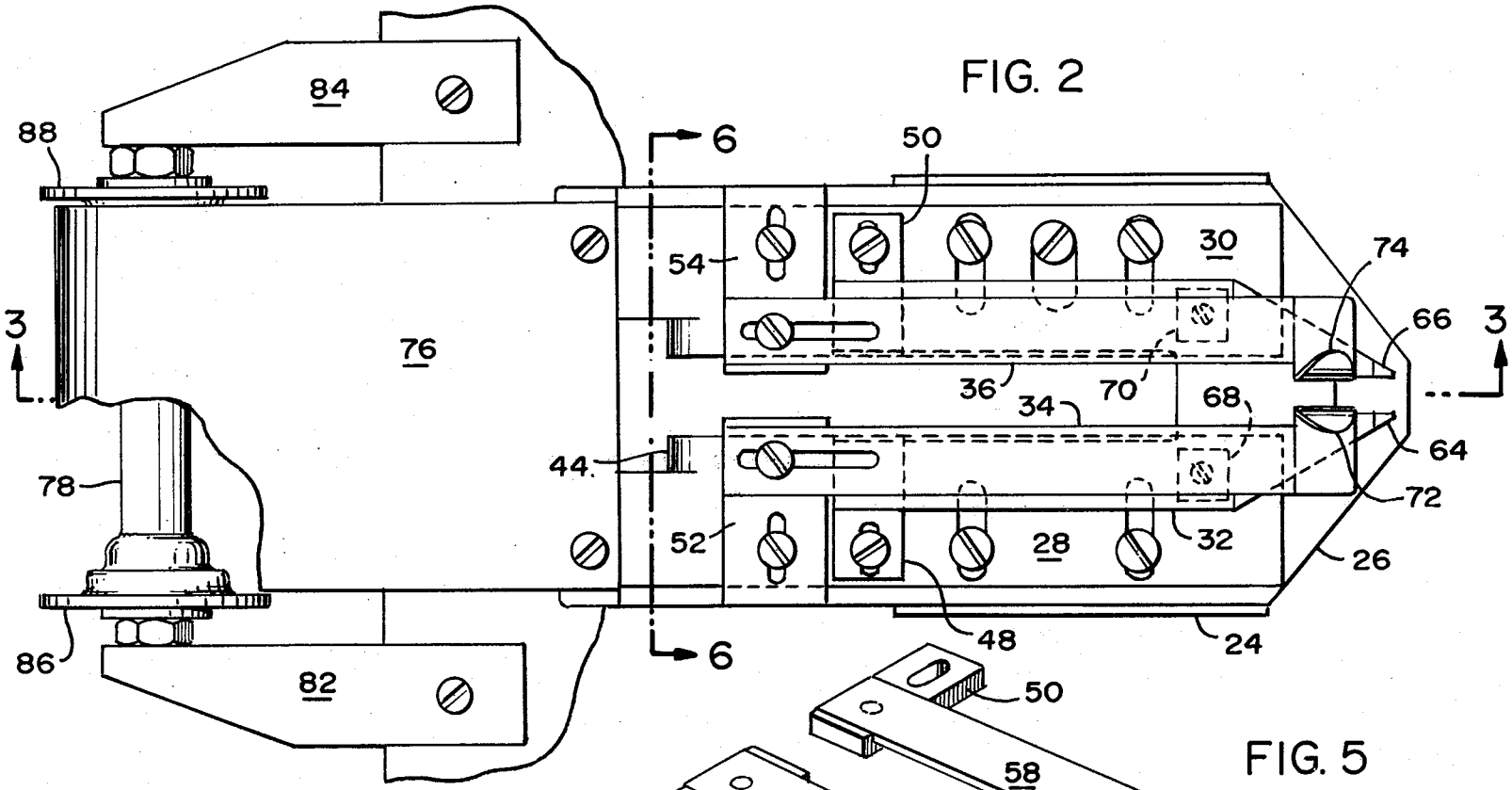
FIG. 2 is a top plan view of the apparatus shown in FIG. 1.

Referring to FIGS. 1–4, the invention is embodied in a guide assembly for feeding a slide fastener strip 10 and a strip of backing material 12 to a sewing machine 14 for attachment to a garment or workpiece 16 such as a boot upper. Although precut lengths of slide fastener and backing material may be used, it is preferred to feed continuous strips of each through the device from respective supply reels (not shown) beneath a work table surface 20, appropriate lengths of the strips being severed after the sewing operation.

The guide, which is attached to a table surface 20 adjacent the sewing machine 14, has a base assembly that includes a lower plate 24 and a cover plate 26. A pair of retainer plates 28 and 30, a flexible guide member 32, and two spaced workpiece guides 34 and 36 are attached to the base by screws preferably extending through elongated screw slots, as shown in FIG. 2, that allow the components to be adjusted laterally and lengthwise to accommodate materials of varying dimensions.

Figure 6:
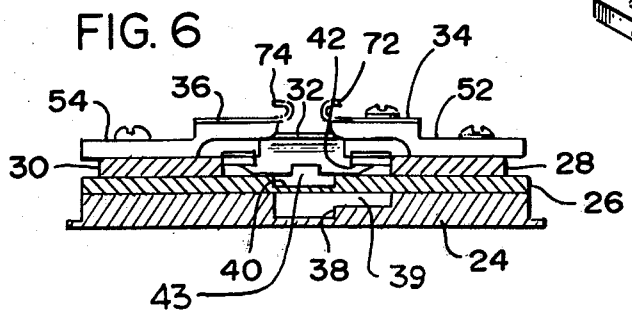
FIG. 6 is a cross-sectional view taken along the line 6—6 in FIG. 2.

In the upper surface of the lower plate 24, there is a stepped groove 38 extending the length of the plate 24 toward the sewing machine needles. With the cover plate 26 in place, the groove 38 defines a passage 39 through which backing material 12 is fed to the sewing machine. The cover plate 26 has a groove 40 extending along its upper surface to provide a relief for the fastener coupling elements. The retainers 28 and 30, which are attached to the top of the cover plate 26 parallel one another on either side of the groove 40, have opposed rabbets 42 along their lower inner edges to receive the outer edges of the fastener mounting tapes. Referring to FIG. 6, it can be seen that the retainers 28 and 30 cooperate with the cover plate 26 to define a channel 43 through which the fastener 10 may pass. A portion 44 of each retainer 28 and 30 is bent upward at the inlet or rearward end of the channel 43 to facilitate insertion of the fastener. The forward edge of each retainer 28 and 30 is downwardly bevelled to provide clearance for the guide member 32.

Referring to FIG. 2, a pair of mounts 48 and 50 for supporting the flexible guide member 32 are attached by screws atop the respective retainers 28 and 30. Immediately forward of the mounts are a pair of grooved standoffs 52 and 54, also attached by screws atop the retainers 28 and 30, which support the workpiece guides 34 and 36 in canteliever fashion.

Figure 5:
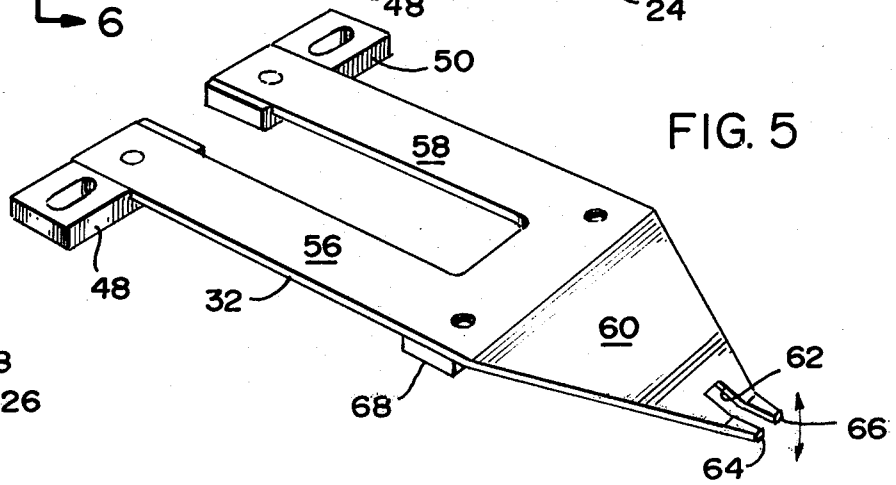
FIG. 5 is an isometric view of a guide portion of the apparatus.

The guide member 32, shown in detail in FIG. 5, includes two spaced arms 56 and 58 extending rearward from a generally triangular nose portion 60. A pair of integral fingers 64 and 66, separated by a notch 62 having a width approximately equal to that of the interlocked coupling elements, extend forward from the nose portion toward the sewing machine 14. The ends of the fingers 64 and 66 are parallel to but downwardly offset from the arms 56 and 58 so that the fingers 64 and 66 may bear against the mounting tapes of a slide fastener passing through the guide. A pair of square bosses 68 are welded to the lower side of the nose 60, and a threaded hole extending through each boss receives an adjustment screw 70 which may be turned in or out to adjust the clearance beneath the fingers, depending on the thickness of the fastener tapes. The coupling elements are closely confined within the notch 62 by the fingers 64 and 66, whereby lateral shifting of the slide fastener is prevented by contact between the fingers and the coupling elements. The proximity of the fingers 64 and 66 to the sewing machine 14 minimizes lateral wandering of the fastener 10 between the guide and the sewing machine, thereby insuring accurate alignment.

In view of the fact that a slider is substantially wider than its interlocked coupling elements, and therefore cannot pass through the notch 62, the member 32 is made sufficiently flexible that it can be displaced upward to allow a slider or other component, such as a fastener bottom stop, to pass beneath the fingers 64 and 66. The fingers maintain their positions astride the coupling elements at all times except when a slider is beneath them so that only momentary interruptions of their alignment function are caused by passage of a slider through the channel 43.

The workpiece guides 34 and 36 are spaced apart laterally to provide an unobstructed view of the fastener. At the forward end of the workpiece guides 34 and 36, there are upwardly extending arcuate tongues 72 and 74 respectively that engage the edges of the opening in the workpiece and align it with the slide fastener below.

It is preferred to feed slide fastener and backing material from supply reels beneath the table surface 20 over the edge of the table and into their respective positions in the guide. As an aid in moving the fastener and backing material over the table edge and into the guide in an organized manner, an arcuate entrance slide 76 (FIGS. 1, 2 and 3) is secured to the rear of the base 24, extending in canteliever fashion well over the table edge. Beneath the slide 74, a spool 78 is journalled on an axle 80, the ends of which are fixed to brackets 82 and 84 that extend rearward from the table edge. Flanges 86 and 88 on the spool laterally confine the components 10 and 12 as they move over the slide 74 and the spool 78. As shown in FIG. 3, the fastener 10 is run from beneath the table over the slide and into the channel 43 while backing material 12 passes over the spool 78 beneath the slide 76, into the passage 39. The slide 76 and spool 78 provide relatively frictionless movement for the fastener and backing material around the table edge, and keep them separate as they enter the guide. Furthermore, the slide fastener 10 and backing material 12 approach the guide substantially aligned with the slots so as not to catch on the edges of the guide.

The sewing machine 14 referred to above is shown in phantom in FIG. 1, and includes an inside presser foot 90 and an outside presser foot 92, which cooperate with a feeder 94 and a feed plate 96 to draw the components 10, 12 and 16 through the guide assembly and beneath needles 98 that join the components in conventional fashion.

In operation, a continuous fastener 10 and backing material 12 are drawn from supply reels (not shown) beneath the table, and are passed over the entrance slide 76 and spool 78 respectively. The backing material is inserted, with one edge folded, into the passage 39 and is drawn through to the sewing machine for engagement by the feed plate 96. The fastener 10 is passed through the channel under the guide member fingers 64 and 66 and under the presser foot 92 to overlie the backing material. At this point, the fastener is fully visible to the operator except for a short segment hidden by the nose portion 60. The workpiece is also introduced to the sewing machine, its edges being passed next to the tongues 72 and 74. As the sewing machine is actuated by the operator, its feeder 94 draws the assembled materials under the needles 98 which form seams extending along each mounting tape. When sewing is concluded, the fastener 10 and backing material 12 are severed by the operator, portions of each remaining protruding from the guide for attachment to a subsequent workpiece.

An advantage of the guide described above is that the fastener and workpiece remain almost completely visible throughout the sewing operation. The operator can clearly see sliders or other components before they reach the sewing needles, thereby aiding him in positioning or avoiding such components. Threading of a fastener through the channel is also facilitated by the improved visibility provided by the guide.

A further advantage of the invention is that lateral alignment of the fastener is very accurately maintained by the fingers, which remain in contact with the tape close to either side of the interlocked coupling elements. This contact is broken only for the short distance that a fastener is underneath the fingers 64 and 66.

Inasmuch as the invention is subject to many modifications, variations and changes in detail, it is intended that all matter contained in the foregoing description or shown in the accompanying drawings shall be interpreted as illustrative and not in a limiting sense.

What is claimed is:

1. A slide fastener guide assembly for aligning a slide fastener, which includes two mounting tapes supporting respective rows of coupling elements interlocked by a slider, with a workpiece as the fastener and the workpiece are fed into a sewing machine, said assembly comprising means for engaging a longitudinal opening in the workpiece;

said engaging means including guide means for said workpiece;

a base having a channel for supporting the fastener, said base being attached to said workpiece guide; and a guide member for laterally positioning the slide fastener within the channel, said guide member including a nose portion, a pair of spaced arms extending rearward from opposite sides of said nose portion parallel to and above said channel, the arms being attached at their rearward ends to the base, and a pair of fingers extending forward from the nose portion, said fingers having a space therebetween approximately equal to the width of the interlocked coupling elements, the fingers being downwardly offset from the arms so as to bear against the mounting tapes adjacent the coupling elements;

said guide member having sufficient flexibility that the fingers may be temporarily displaced upward by a slider moving thereunder.

2. A slide fastener guide assembly as recited in claim 1 wherein the base has a groove in the upper surface thereof for receiving a lower portion of the interlocked coupling elements and a pair of retainer plates are attached to the upper surface of the base, each retainer having a rabbet along its lower inner edge to receive a respective mounting tape, said retainer plates being lateraly spaced so as not to obscure said coupling elements.

3. A slide fastener guide assembly as recited in claim 2, said base further having a passage defined therethrough parallel to said channel for feeding backing material into a sewing machine in alignment with the workpiece and the slide fastener.

4. A slide fastener guide assembly as recited in claim 3 wherein the backing material passage has a step therein so that backing material having a folded edge may pass through the passage.

5. A slide fastener guide assembly as recited in claim 1 wherein the workpiece engaging means includes a pair of laterally spaced workpiece guides extending parallel to and above said arms, an upwardly extending tongue at the forward end of each workpiece guide for engaging a respective folded edge of said workpiece, the rearward end of each workpiece guide being attached to said base.

6. A slide fastener guide assembly as recited in claim 3, 4 or 5 further including a table surface adjacent the sewing machine, said base being mounted on said table surface, a spool rotatably supported at an edge of said table surface for transferring backing material from below the table surface to said passage, and an arcuate entrance slide attached to the base and extending over the spool for transferring fastener stock from below the table surface to said channel.

* * * * *